US006311864B1

(12) United States Patent
Land

(10) Patent No.: US 6,311,864 B1
(45) Date of Patent: Nov. 6, 2001

(54) UNIVERSAL SANITARY SHIELD FOR MEDIA DISPENSERS

(76) Inventor: Glenn E. Land, 3221 Old River La., Independence, VA (US) 24348

( * ) Notice: Subject to any disclaimer, the term of this patent is extended or adjusted under 35 U.S.C. 154(b) by 0 days.

(21) Appl. No.: 09/552,660

(22) Filed: Apr. 19, 2000

(51) Int. Cl.[7] ..... B65D 65/00
(52) U.S. Cl. ..... 220/737; 220/718; 220/908
(58) Field of Search ..... 220/737, 731, 220/727, 718, 716, 23.91, 908

(56) References Cited

U.S. PATENT DOCUMENTS 1,709,537 * 4/1929 Owen ..... 220/908 X
1,715,861 * 6/1929 Owen ..... 220/908 X
2,552,318 * 5/1951 Hartmann ..... 220/718
2,678,764 * 5/1954 Carlson ..... 220/495.11 X
2,782,614 * 2/1957 Currie ..... 220/718
3,021,977 * 2/1962 Hester ..... 220/718
4,715,510 * 12/1987 van der Meulen et al. ..... 220/718
5,636,871 * 6/1997 Field ..... 220/495.08 X

* cited by examiner

*Primary Examiner*—Steven Pollard
(74) *Attorney, Agent, or Firm*—Jones, Tullar & Cooper, P.C.

(57) ABSTRACT

A sanitary shield for dispensers includes a generally cylindrical body having an upper end for engaging a dispenser terminal and an open lower end extending beyond and surrounding the bottom of the terminal.

1 Claim, 2 Drawing Sheets

UNIVERSAL SANITARY SHIELD FOR MEDIA DISPENSERS

BACKGROUND OF THE INVENTION

The present invention relates generally to sanitary shields and more particularly to universal sanitary shields for media dispensers. Still more specifically, the present invention relates to sanitary shields which prevent contamination of dispenser terminals and media or products they dispense, by preventing direct contact between the dispenser terminals and the dispenser users or other foreign matter.

Many types of dispensers are known to the art for dispensing media or products. Such dispensers are known for use, for example, in the medical field, for industrial products such as dry chemicals and for various food products, such as ice cream, desert toppings, nuts, coffee, candy, soft drinks, water and the like. However these dispensers do not provide protection from contamination for the media or products being dispensed from contamination. Contamination of the dispenser terminals and the media or products they dispense may easily occur when contact is made with the user or foreign matter because the dispenser terminals are exposed. For example, children have been observed touching terminals of soda dispensers, water coolers and ice cream dispensers when they may have germs on their hands. Also people have been observed coughing or sneezing in close proximity to dispenser terminals. It is, therefore, highly desirable to provide a sanitary shield to prevent such contamination.

SUMMARY OF THE INVENTION

It is a primary object of the present invention to provide a universal sanitary shield for media or product dispensers to protect the dispensing media or products and the dispenser terminals from contamination.

Another object of the present invention is to provide a device that effectively shields dispenser terminals and dispensing media or products from contact by users or other foreign matter.

Another object of the present invention is to provide a universal sanitary shield that is economical to manufacture and which may be readily manufactured, and easily be put on and taken off of a dispenser for replacement or cleaning by unskilled workers.

Another object of the present invention is to provide a device that may comprise a single component which may be made entirely of a single material such as a polycarbonate or other clear plastic material that can afford a good view of the product or media being dispensed.

Briefly, the present invention is directed, in its preferred embodiment, to a universal sanitary shield which effectively protects the terminals of dispensers and media, or products they dispense, from becoming contaminated from contact with users or with foreign objects such as air-born germs when someone sneezes or coughs. The sanitary shield is preferably a single component and preferably comprises a generally cylindrical shape somewhat larger in diameter and longer in length than the dispenser terminal and having open ends. It is preferably constructed of a clear plastic resin such as polycarbonate, but may be of glass, metal or other suitable material. One end of the shield is designed to snap, twist or otherwise be engageably attachable to a dispenser or dispenser terminal in such a way as to position the shield to effectively protect the dispenser terminal. The other end of the shield preferably terminates slightly beyond the end of the dispenser terminal. Thus, the universal sanitary shield prevents a user from contaminating the terminal by touching it and prevents contamination by shielding the terminal from a user sneezing or coughing on it.

Although four embodiments are illustrated, it will be understood that the device can be manufactured in a variety of shapes and sizes to accommodate a wide variety of dispensers or dispenser terminals. It will become clear that the present invention provides a unique and desirable device for dispensers by creating a sanitary shield for protecting dispenser terminals and dispensing media or products from contamination.

BRIEF DESCRIPTION OF THE DRAWINGS

The foregoing, and additional objects, features and advantages of the present invention will be more fully understood by reference to the following detailed description of the preferred embodiments thereof, taken in conjunction with the accompanying drawings, in which.

DESCRIPTION OF PREFERRED EMBODIMENTS

Figure 1:
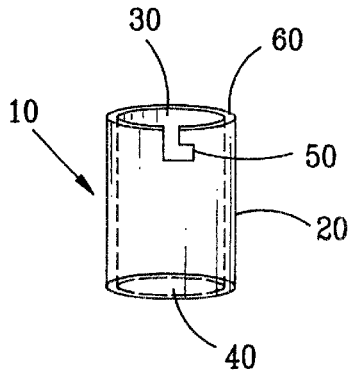
FIG. 1 is a perspective view of a sanitary shield for a typical dispenser terminal illustrating a preferred form of the present invention.

Turning now to a more detailed consideration of the present invention, there is illustrated in FIG. 1 a perspective view of a universal sanitary shield 10, for a typical media or product dispenser. The shield 10 includes a cylindrical body 20 with an open top 30, and an open bottom 40 for providing contamination protection for media or product being dispensed from a dispenser, generally L-shaped and a locking slot 50 in the body 20 extending downwardly from a top edge 60 of the body, for attaching and securing the shield 10 to a typical dispenser or dispenser terminal.

The body 20 preferably is a single component which comprises a generally cylindrical form, length and diameter to conform to a typical dispenser or dispenser terminal. It is preferably constructed of a clear plastic resin, such as a polycarbonate, for providing a clear view of media or product being dispensed, with the wall of the body 20 being sufficiently thick to provide the desired stiffness and strength to allow it to be secured on a dispenser.

Figure 2:
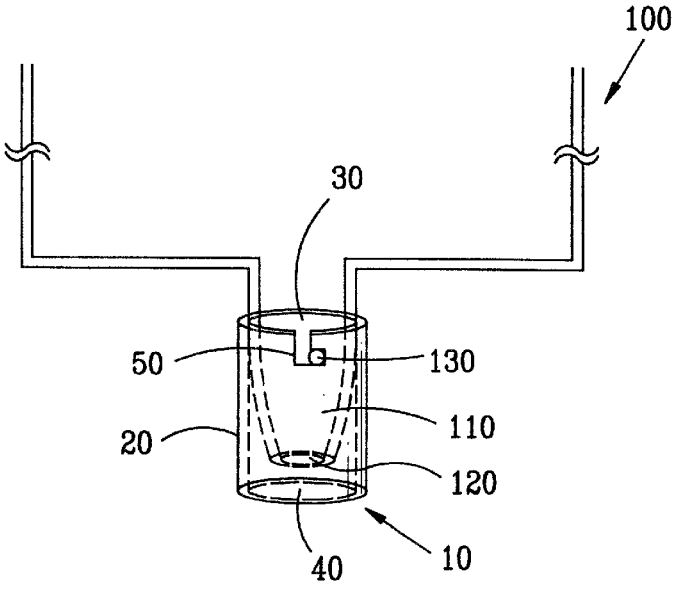
FIG. 2 is a perspective view of the sanitary shield of FIG. 1 attached to a typical dispenser terminal of a media or product dispenser.

In FIG. 2, the function of the sanitary shield 10 will become clear when taken in conjunction with a typical dispenser, indicated at 100. The dispenser 100, which is shown for illustrative purposes, includes a dispenser terminal 110 with an open end 120 for dispensing a media such as soft drinks, water, ice cream, nuts, coffee, candy, desert toppings, diy chemicals, medicine, pills or the like. It also includes a pen or locking-knob 130 for engaging the slot 50 and securing the sanitary shield 10.

The shield 10 is slightly larger in diameter and somewhat longer than the dispenser terminal 110. An unskilled worker can readily attach the shield 10 to the dispenser 100 by sliding the shield upwardly so that the locking-knob 130 on the dispenser terminal 110 engages the locking-slot 50 of shield 10. Thus the shield 10 is attached simply by pushing it on and turning it to secure it in place. This embodiment may be desirable, for example, if the dispenser terminal 110 is a quick connect or detachable component of the dispenser 100. Alternatively, the shield 10 may be attached directly to the body of the dispenser 100 by various other connectors. For example, the attachment of the shield 10 to the dispenser 100 or to the dispenser terminal 110 may be in any manner as is known in the industry, such as snap-on, lock-on, screw-on or the like.

Figure 3:
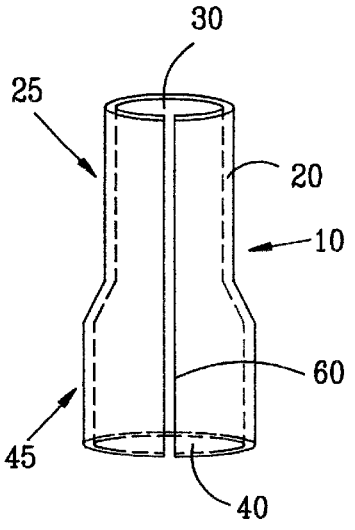
FIG. 3 is a perspective view of a sanitary shield for a typical dispenser terminal illustrating a second embodiment of the present invention.
Figure 4:
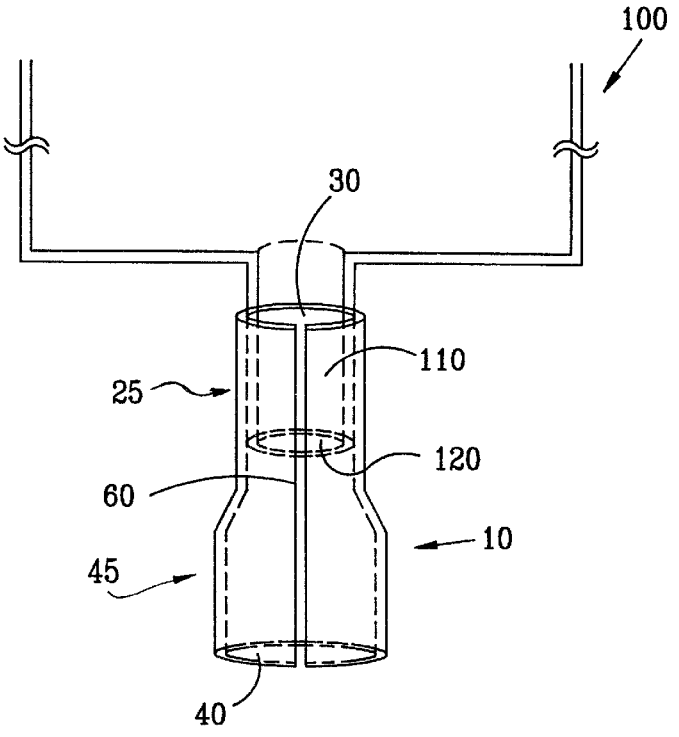
FIG. 4 is a perspective view of the sanitary shield of FIG. 3 attached to a typical dispenser terminal.

A second embodiment of the invention is illustrated in FIGS. 3 & 4. The sanitary shield 10 is similar to that of FIGS. 1 & 2, the difference being that a lower portion, indicated at 45, is larger in diameter than an upper portion, indicated at 25, of the body 20 and the locking-slot 50 (FIG. 1) has been replaced by an expansion-space or slot 60. The expansion-space 60 extends the full length of the shield, and allows the shield 10 to expand when pushing it onto the dispenser terminal 110. The material of the shield is flexible and tends to return the expansion space 60 to its original size, so that the upper portion 25 of the shield 10 contracts to engage the outer surface of the dispenser terminal to hold the shield 10 in place. This embodiment may be desirable, for example, if the dispenser terminal 110 has a constant diameter, such as typical tubing or the like. If so desired the expansion space 60 may extend only partially along the length of the shield 10.

In operation, the universal sanitary shield 10 of FIGS. 1–4 creates a sanitary barrier between a typical dispenser terminal 110 and potential contamination, such as from a person sneezing or coughing in close proximity of the dispenser terminal 110 or from a child touching the terminal 110. Therefore, the sanitary shield 10 provides protection from germs and other contamination for the dispenser terminal 110 and for any media or product it may be dispensing.

Figure 5:
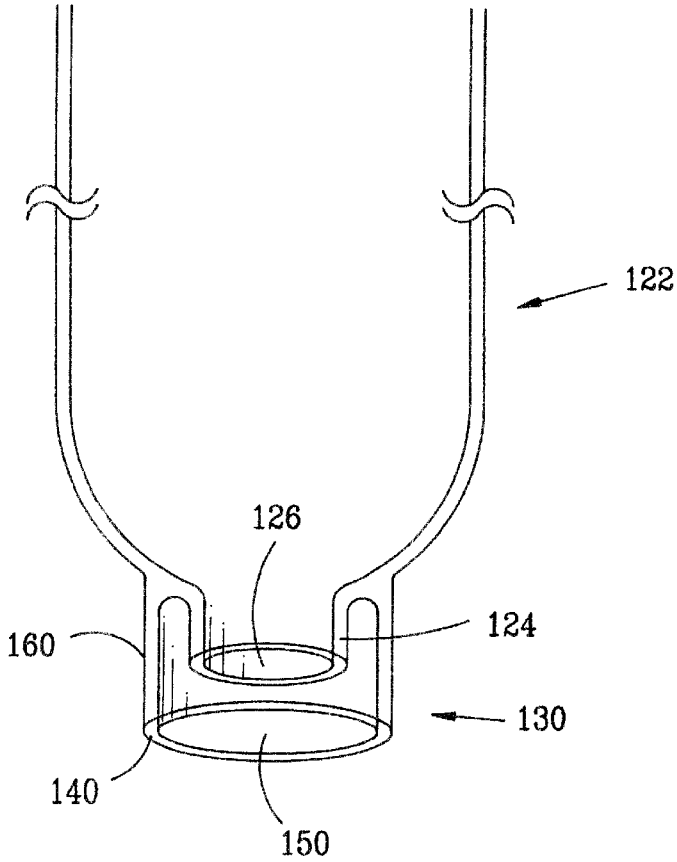
FIG. 5 is a perspective view of a transparent sanitary shield for a dispenser terminal illustrating a third embodiment of the present invention.

FIG. 5 illustrates an alternative embodiment of the universal sanitary shield 10 of the present invention. This embodiment may, for example, be desirable for a typical bottle for dispensing pills, as indicated at 122. The dispenser 122 includes a dispenser terminal 124 having an open end 126 for dispensing media or product such as pills. The bottle 122 includes an integral shield 130, having a circumferential wall, or body portion 140 with an open end 150 which is slightly larger in diameter and longer than the dispenser terminal 124. The dispenser 122 may, if so desired, be a typical medicine or pill bottle in outside appearance, the difference being that it incorporates the inner dispenser terminal 124 and the outer shield 130. The body 140 of shield 130 may have typical threads on its outer surface, at 160 for attaching a cap or lid (not shown) in known manner, or if desired the cap can be attached to the dispenser terminal 124 to cover opening 126.

Figure 6:
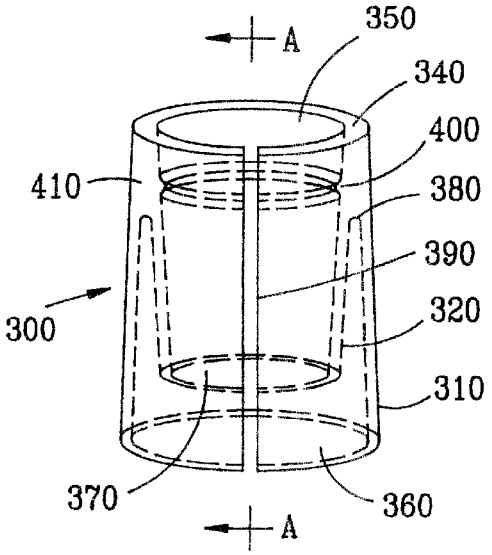
FIG. 6 is a perspective view of a sanitary shield illustrating a fourth embodiment of the present invention.
Figure 7:
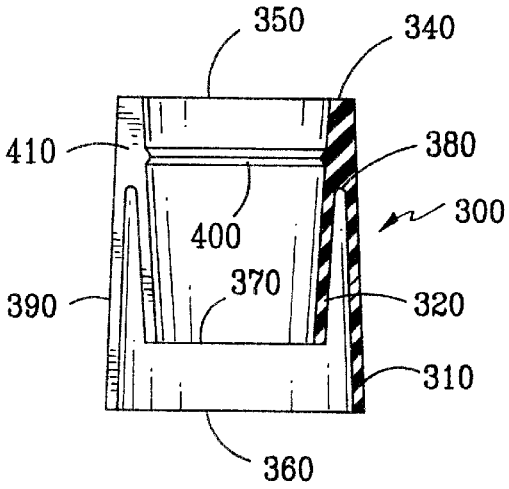
FIG. 7 is a cross-sectional side elevation view taken along line A—A of FIG. 6.

FIGS. 6 & 7 illustrate a combination, indicated at 300, of a sanitary dispenser shield 310 surrounding a dispenser terminal 320 and comprising a single component. It is preferably constructed of a clear plastic resin, such as a polycarbonate, and may be generally cylindrical in form. FIG. 6 is a perspective view and FIG. 7 is a cross-sectional view, taken along line A—A of FIG. 6.

The combination 300 includes a common top rim 340 and a common open top 350 shared by the shield 310 and the terminal 320. An open bottom end 360 of shield 310 is separate from an open bottom end 370 of the terminal 320. As in the other described embodiments, the length of the shield 310 is somewhat longer than the length of the terminal 320 to provide a sanitary barrier around and beyond the end 370 of the terminal 320. At the uppermost region of combination 300, the shield 310 and terminal 320 share a common portion 410. At a pre-determined distance below the top rim 340, the shield 310 and terminal 320 separate at a junction 380. The combination 300 also includes an expansion joint 390, similar to the expansion-space 60 of FIGS. 3 & 4. It further includes a typical inwardly extending snap protrusion 400 near its top inner circumference.

As best illustrated in FIG. 7, the shield 310 may have the same diameter for its entire longitudinal length from top to bottom. However, if desired, its bottom diameter may be somewhat larger than the top. The portion of the terminal 320 that separates from the shield 310 at the bottom of the common portion 410, at junction 380, is preferably conical in form, tapering inwardly with its bottom open end 370 being somewhat smaller in diameter than its common open top 350 diameter.

The fourth embodiment may, for example, replace a typical snap-on dispenser terminal with the combination 300 providing a terminal 320 and a sanitary shield 310, for a container or other dispenser. The snap protrusion 400 and the expansion joint 390 allow an unskilled worker to readily attach the combination 300 to a typical dispenser (not shown) that utilized a snap on dispenser terminal.

In operation, the very desirable function of the combination 300 is the same as the other described embodiments.

Thus it will be seen that the universal sanitary shields for media dispensers of the present invention is unique. It provides a barrier between a typical dispenser terminal and potential contamination, such as a person sneezing or coughing in close proximity of the dispenser terminal. It is a highly desirable device that provides protection from germs and other contaminants for a dispenser terminal and any media or product being dispensed.

Although the invention has been described in terms of preferred embodiments, it will be understood that these are exemplary and that the scope of the invention is limited only by the following claims.

What is claimed is:

1. A sanitary shield for dispensers, comprising:

a single component, generally cylindrical body having an upper common portion, an integral inner dispenser portion depending from said common portion, and an integral outer shield portion depending from said upper common portion and surrounding said inner dispenser portion;

said single common portion including an open upper end for surrounding and engaging a dispenser outlet and aligning said inner dispenser portion with the outlet;

a snap ring within said common portion for engaging said outlet and securing said common portion to the outlet;

said outer shield portion having a top portion integral with said common portion and a depending side wall spaced outwardly from, surrounding and extending below said dispenser portion to shield said dispenser portion from external contaminants; and an expansion joint in said body to permit attachment of said common portion of said body to a dispenser outlet.

* * * * *